United States Patent [19]

Saito

[11] Patent Number: 4,475,286

[45] Date of Patent: Oct. 9, 1984

[54] SAFETY RAZOR

[75] Inventor: Tatsuya Saito, Seki, Japan

[73] Assignee: Kabushiki Kaisha Kaijirushi Hamono Center, Gifu, Japan

[21] Appl. No.: 294,807

[22] Filed: Aug. 20, 1981

[30] Foreign Application Priority Data

Oct. 20, 1980 [JP] Japan ..... 55-145745

[51] Int. Cl.[3] ..... B26B 21/14

[52] U.S. Cl. ..... 30/87; 30/85; 30/50; 30/51

[58] Field of Search ..... 30/87, 50, 47, 40.2, 30/85, 51, 57, 58

[56] References Cited

U.S. PATENT DOCUMENTS

| | | | |
|---|---|---|---|
| 2,676,396 | 4/1954 | Testi | 30/87 X |
| 3,964,159 | 6/1976 | Ferraro | 30/50 X |
| 4,227,302 | 10/1980 | Torrance | 30/87 X |

*Primary Examiner*—E. R. Kazenske
*Assistant Examiner*—Willmon Fridie, Jr.
*Attorney, Agent, or Firm*—Koda and Androlia

[57] ABSTRACT

A safety razor having a pivotable head and a holder holding the head, wherein elastic members are interposed therebetween, one of the members is a bridge provided on the undersurface of the head and can be bent along the direction of the axis of the holder, and the other member is a long tongue plate provided at the center of the bridge and can be bent in a vertical direction of the axis of the holder, thereby resulting in smooth pivoting motion of the head.

1 Claim, 5 Drawing Figures

SAFETY RAZOR

BACKGROUND OF THE INVENTION

1. Field of the Invention

This invention relates to a safety razor, and more particularly to a safety razor having a pivotable head.

2. Prior Art

Light and disposable safety razors with a pivotable head known prior to the present patent application have only one elastic part for returning the head to its original position after the head had pivoted. In such safety razors, a single, long tongue plate is interposed between the head and the holder. One end of this long tongue plate is integrally connected to the undersurface of the head, while the other end is anchored in an indentation formed in the top of the holder. When the head is pivoted, the end of the long tongue plate anchored in the indentation moves slightly upward and downward as the long tongue plate bends. This produces a rattle of the head; as a result, such a razor suffers from a drawback in that the pivoting motion lacks smoothness. Furthermore, if the long tongue plate is made longer so that it is constantly in a bent state, a considerable force is required to reverse the direction of the bend when the head is pivoted. Accordingly, in such a case as well, the pivoting motion of the head lacks smoothness.

SUMMARY OF THE INVENTION

Accordingly, it is a general object of the present invention to provide a light and disposable safety razor having an improved pivotable head.

In keeping with the principles of this invention, the objects of this invention are accomplished by a unique structure for a safety razor comprising a head, holder and returning member, in which the head is attached to the holder so as to be pivoted about an axis extending along the length of the head, a returning member which elastically returns the head to its original position after it is pivoted is interposed between the head and the holder; and the returning member consists of a linkage between two types of elastic parts, that is, between an elastic part which can be bent backward and forward relative to the safety razor and an elastic part which can be bent upward and downward relative to the safety razor.

BRIEF DESCRIPTION OF THE DRAWINGS

The above-mentioned features and objects of the present invention will become more apparent with reference to the following description taken in conjunction with the accompanying drawings wherein like reference numerals denote like elements, and in which.

DETAILED DESCRIPTION OF THE INVENTION

Figure 1:
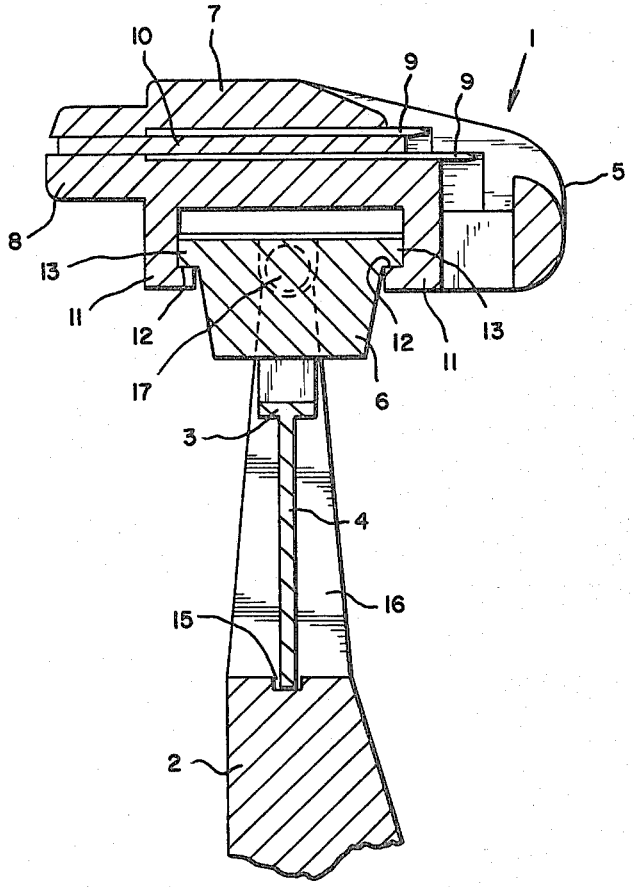
FIG. 1 is a cross sectional view of the adjacent portion to the head in accordance with the teachings of the present invention.
Figure 2:
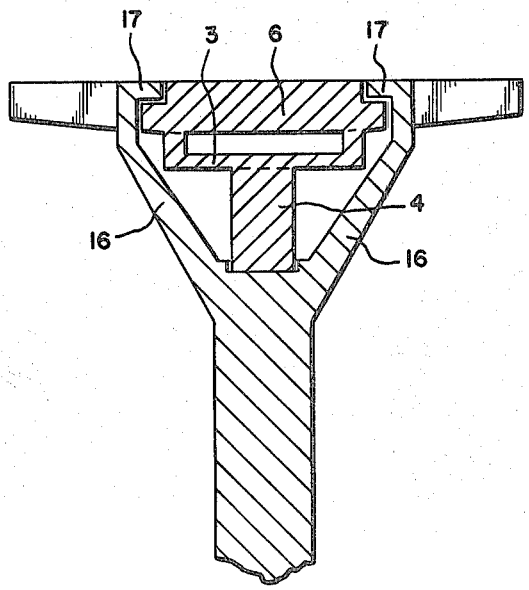
FIG. 2 is a cross-sectional view of the upper portion of the holder joined with the connecting member.
Figure 3:
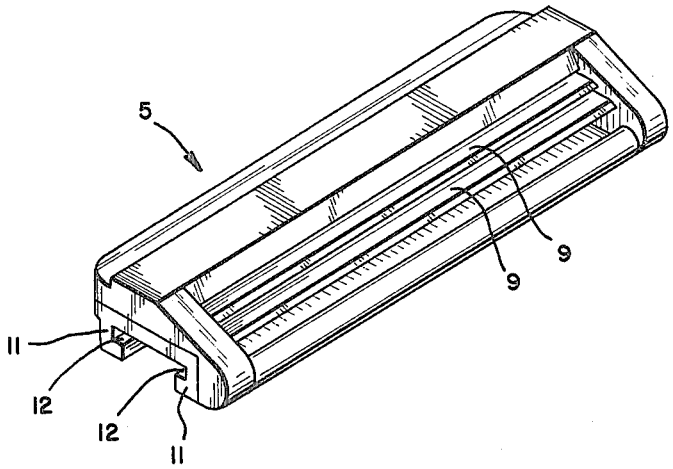
FIG. 3 is an oblique view of the blade assembly.
Figure 4:
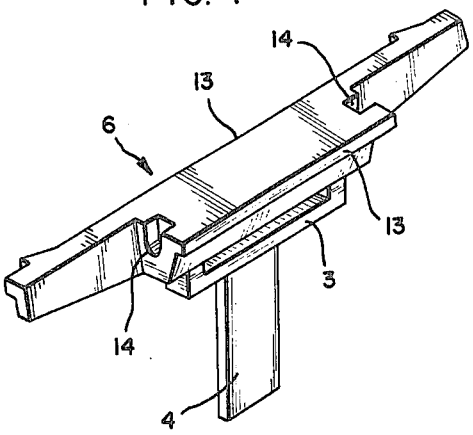
FIG. 4 is an oblique view of the connecting member.
Figure 5:
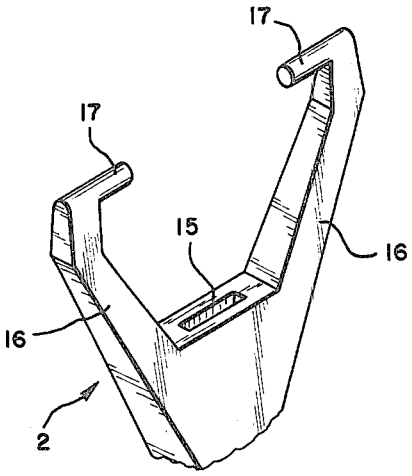
FIG. 5 is an oblique view of the upper portion of the holder.

Referring more particularly to the drawings, a head 1 consists of a blade assembly 5 and a connecting member 6. In the blade assembly 5, two blades 9, 9 are clamped between an upper plate 7 and a blade mount 8, and a spacer 10 is interposed between the two blades 9, 9. Projections 11, 11 which are letter "L"-shaped in cross-section, that is, in a section perpendicular to the length of the head 1, are formed on the undersurface of the blade mount 8 so that they extend along the entire length of the blade mount 8; as a result, a pair of parallel inward-facing channels 12, 12 are formed.

The connecting member 6 connects the blade assembly 5 to a holder 2. A pair of parallel outwardfacing projections 13, 13 are formed so that they extend along the length of the connecting member 6. The head 1 is assembled with the connecting member 6 by sliding these projections 13, 13 into the channels 12, 12 of the blade assembly 5 from the side so that the connecting member 6 and blade assembly 5 are fastened together, forming the head 1. Furthermore, a bridge 3 is integrally formed on the undersurface of the connecting member 6 and a long tongue plate 4, which projects downward and is made with elastic material, is formed in the center of the undersurface of the bridge 3 as an integral part of the bridge 3. Furthermore, bearing slots 14, 14 are formed between the projections 13, 13 of the connecting member 6.

An indentation 15 is formed on the top surface of the holder 2, and a pair of arms 16, 16 formed as integral parts of the holder 2 projects upward from both sides of the indentation 15. Inward-facing shafts 17, 17 are formed on the tips of these arms 16, 16.

In order to assemble above parts, i.e., blade assembly 5, connecting member 6 and holder 2, into a finished product, the shafts 17, 17 on the arms 16, 16 is caused to ride across the upper surface of the shorter one of the two projections 13, 13 on the connecting member 6 so that the shafts 17, 17 are inserted into the bearing slots 14, 14. Afterward, the long tonque plate 4 is bent slightly and the tip of it is forced into the indentation 15 to be anchored. Then, push the blade assembly 5 from the side into the connecting member 6 so that the projections 13, 13 fit into the channels 12, 12.

Instead of a head made up of the blade assembly 5 and connecting member 6 as shown in the drawings, the head 1 could also consist simply of a blade assembly without a connecting member. In such a case, bearing slots, a bridge and a long tongue are formed directly on the undersurface of the blade assembly 5.

As described above, the invention can elastically return the head 1 to its original position, after the head 1 pivoted, by the action of an elastic part, i.e., the long tongue plate 4 which can be bent backward and forward relative to the safety razor, that is, the long tongue plate 4 can be bent in the vertical direction to the axial line of the holder 2. Furthermore, this long tongue plate 4 is connected to an elastic part, i.e., the bridge 3 which can be upward and downward relative to the safety razor, that is, the bridge 3 can be sent in the direction of the axial line of the holder 2. For all practical purposes, therefore, the effect is the same as if a certain amount of play were provided in the direction of length of the long tongue plate 4.

Accordingly, when the direction of the bend in the long tongue plate 4 is reversed as the head 1 is pivoting during use, the force applied to the long tongue plate 4 is absorbed by the bending of the bridge 3, resulting in a smooth pivoting motion of the head 1.

We claim:

1. A safety razor comprising:

a holder;

a head pivotably coupled to said holder, said head comprising:

a connecting member pivotably coupled to said holder and having a pair of parallel outwardly facing projections extending along the length of said connecting member; and a blade assembly slidably coupled to said connecting member by a pair of inwardly-facing parallel channels which slidably engage with said outwardly facing projections; and a return member interposed between the holder and the head, which elastically returns the pivotal head to an original position and said returning member having a first elastic element which can be bent in a direction of a longitudinal axial line of the holder, and a second elastic element which can be bent in a direction perpendicular to said longitudinal axial line of the holder, said first elastic element comprising a bridge formed on an undersurface of said connecting member and said second elastic element comprising a long tongue plate projecting from said bridge at one end and anchored to said holder at another end.

* * * * *